US006880916B2

(12) United States Patent
Kim

(10) Patent No.: US 6,880,916 B2
(45) Date of Patent: Apr. 19, 2005

(54) INK-JET PRINTHEAD AND METHOD OF MANUFACTURING THE SAME

(75) Inventor: Yun-gi Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/396,409

(22) Filed: Mar. 26, 2003

(65) Prior Publication Data

US 2003/0231227 A1 Dec. 18, 2003

(30) Foreign Application Priority Data

Jun. 17, 2002 (KR) ..... 10-2002-0033724

(51) Int. Cl.[7] ..... B41J 2/14; B41J 2/16
(52) U.S. Cl. ..... 347/47
(58) Field of Search ..... 347/47, 63, 64

(56) References Cited

U.S. PATENT DOCUMENTS 4,535,343 A * 8/1985 Wright et al. ..... 347/64
4,882,595 A 11/1989 Trueba et al.
5,163,177 A * 11/1992 Komura ..... 347/64
5,291,226 A * 3/1994 Schantz et al. ..... 347/63
5,912,685 A 6/1999 Raman
6,130,688 A * 10/2000 Agarwal et al. ..... 347/47

FOREIGN PATENT DOCUMENTS

JP 11-070661 3/1999

* cited by examiner

*Primary Examiner*—Michael S. Brooke
(74) *Attorney, Agent, or Firm*—Staas & Halsey LLP

(57) ABSTRACT

An ink-jet printhead and a method of manufacturing the ink-jet printhead include a substrate on which at least one heater and a passivation layer protecting the at least one heater are formed, a passage plate formed on the substrate to provide a chamber corresponding to the at least one heater, and a nozzle plate in which an orifice corresponding to the chamber is formed. The passage plate is formed of photoresist, and the nozzle plate is formed of a silicon-family material at a temperature limited by characteristics of the passage plate.

21 Claims, 9 Drawing Sheets

INK-JET PRINTHEAD AND METHOD OF MANUFACTURING THE SAME

CROSS-REFERENCE TO RELATED APPLICATIONS

This application claims the benefit of Korean Patent Application No. 2002-33724, filed Jun. 17, 2002, in the Korean Intellectual Property Office, the disclosure of which is incorporated herein by reference.

BACKGROUND OF THE INVENTION

1. Field of the Invention

The present invention relates to an ink-jet printhead and a method of manufacturing the ink-jet printhead, and more particularly, to an ink-jet printhead including a nozzle plate having an excellent hydrophobic property and an excellent adhering property, and a method of manufacturing the ink-jet printhead.

2. Description of the Related Art

In Ink-jet printheads, an electro-thermal transducer (ink jet type) generating bubbles in ink using a heat source and ejecting ink droplets by a force generated by the bubbles is mainly used.

FIG. 1 is a perspective view schematically illustrating a structure of a conventional ink-jet printhead, and FIG. 2 is a cross-sectional view of the conventional ink-jet printhead shown in FIG. 1.

As shown in FIGS. 1 and 2, the conventional ink-jet printhead includes a manifold (not shown) to which ink is supplied, a substrate 1 on which a heater 12 and a passivation layer 11 protecting the heater 12 are formed, a passage plate 2 having a passage 22 and an ink chamber 21 formed on the substrate 1, and a nozzle plate 3 which is formed on the passage plate 2 and in which an orifice 31 corresponding to the ink chamber 21 is formed.

In general, the passage plate 2 and the nozzle plate 3 are formed by a photolithography process using polyimide. In the conventional ink-jet printhead, the passage plate 2 and the nozzle plate 3 are formed of the same material, for example, the polyimide. Due to a weak adhering property of the polyimide, the nozzle plate 3 may be detached from the passage plate 2.

In order to solve the above problem, in a conventional method of manufacturing the conventional ink-jet printhead, if the passage plate 2 and the nozzle plate 3 are different layers formed of the polyimide as described above, the passage plate 2 and the nozzle plate 3 are separately manufactured and are then attached to the substrate 1. In this method, due to problems including a structural misalignment, the nozzle plate 3 cannot be attached to the substrate 1 in a form of a wafer and should be attached to each chip separated from the wafer, thereby creating a disadvantage in productivity.

Meanwhile, in another conventional method of manufacturing the ink-jet printhead, a mold layer used as a sacrifice layer to form a chamber and a passage, is formed of a photoresist, then a passage plate and a nozzle plate made of the polyimide are formed on the mold layer as a single layer, and the sacrifice layer is then removed, thereby forming the chamber and the passage. If the passage plate and the nozzle plate are formed using the mold layer, the polyimide cannot be baked at a temperature high enough, so that the mold layer can be protected.

The nozzle plate of the ink-jet printhead directly faces a recording sheet and possesses several factors that influence ejection of ink droplets ejected through a nozzle. Among these factors is a hydrophobic property on a surface of the nozzle plate. If the hydrophobic property is almost non-existent, that is, if the surface of the nozzle plate has a hydrophile property, some of the ink ejected through the nozzle flows out the surface of the nozzle plate, such that the surface of the nozzle plate is contaminated and a size, a direction, and a speed of the ink droplets ejected are not uniform. As described above, the nozzle plate formed of the polyimide has the hydrophile property and thus has the above-mentioned problems. In order to solve these problems caused by the hydrophile property, in general, a coating layer used to form the hydrophobic property should be additionally formed on the surface of the nozzle plate formed of the polyimide. Metal, such as plated nickel (Ni), gold (Au), palladium (Pd), or tantalum (Ta), or a perfluoronated alkane, and silane compound having a high hydrophobic property, such as fluoronated carbon (FC), F-silane, or diamond like carbon (DLC), are used for the coating layer. The hydrophobic coating layer may be formed using a liquid method, such as spray coating or spin coating, and is deposited using a dry method, such as plasma enhanced chemical vapor deposition (PECVD) or sputtering. As a result, the coating layer used to form the hydrophobic property increases manufacturing costs.

SUMMARY OF THE INVENTION

The present invention provides a monolithic ink-jet printhead including a nozzle plate having an excellent hydrophobic property and an improved adhering property with a passage plate.

The present invention further provides a method of manufacturing a monolithic ink-jet printhead in which a nozzle plate and a passage plate are formed on a substrate at a wafer level.

Additional aspects and advantages of the invention will be set forth in part in the description which follows and, in part, will be obvious from the description, or may be learned by practice of the invention.

According to the above and/or other aspects of the present invention, an ink-jet printhead includes a substrate on which at least one heater and a passivation layer protecting the at least one heater are formed, a passage plate formed on the substrate to provide a chamber corresponding to the at least one heater, and a nozzle plate in which an orifice corresponding to the chamber is formed. The passage plate is formed of photoresist, and the nozzle plate is formed of a silicon-family material at a temperature limited by characteristics of the passage plate.

According to another aspect of the invention, the passage plate is formed of polyimide, and the nozzle plate is formed of one material selected from SiN, $SiO_2$, and SiON. According to another aspect of the invention, the nozzle plate is formed through plasma enhanced chemical vapor deposition (PECVD).

It is possible that the nozzle plate includes a first nozzle plate opposite to the passage plate and a second nozzle plate formed on the first nozzle plate, and the nozzle plate further includes a first orifice formed in the first nozzle plate and a second orifice formed in the second nozzle plate. According to another aspect of the invention, the first orifice has a diameter greater than the second orifice.

According to the above and/or other aspects of the present invention, a method of manufacturing the ink-jet printhead includes preparing a substrate on which a heater and a passivation layer protecting the heater are formed, forming a passage plate on which an ink chamber corresponding to the heater and a passage connected to the ink chamber are provided using a first photoresist, filling the ink chamber and the passage with a second photoresist, forming a nozzle plate on the passage plate using a silicon-family low-temperature deposition material, forming an orifice corresponding to the chamber in the nozzle plate, and removing the second photoresist from the chamber through wet etching.

According to another aspect of the invention, the first photoresist is formed of polyimide, and the nozzle plate is formed of $SiO_2$, SiN, or SiON.

It is possible that the filling of the ink chamber and the passage with the second photoresist includes coating the second photoresist on an entire surface of the passage plate, and etching back the coated second photoresist so that a portion of the second photoresist corresponding to only the ink chamber remains.

It is also possible that the forming of the nozzle plate on the passage plate includes depositing the nozzle plate formed of $SiO_2$, SiN, or SiON on the passage plate using plasma enhanced chemical vapor deposition (PECVD).

It is also possible preferable that between operations of forming the nozzle plate on the passage plate and forming the orifice, the first photoresist existing in the chamber is ashed using high-temperature heating, and a residue of the first photoresist is then stripped out from the chamber using a wet etchant.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF EMBODIMENTS

Figure 1:
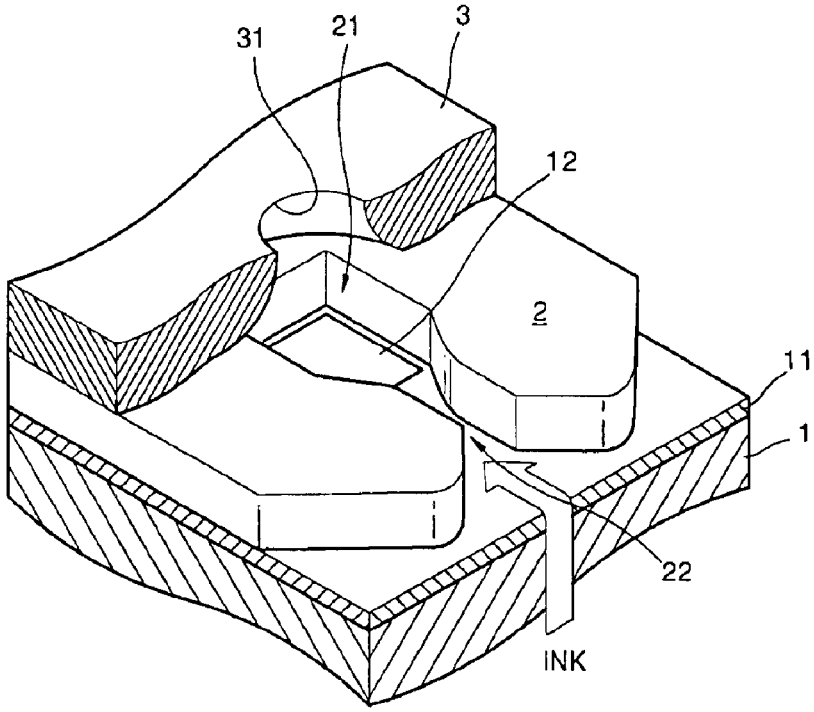
FIG. 1 (PRIOR ART)
FIG. 1 is a perspective view schematically illustrating a structure of a conventional ink-jet printhead.
Figure 2:
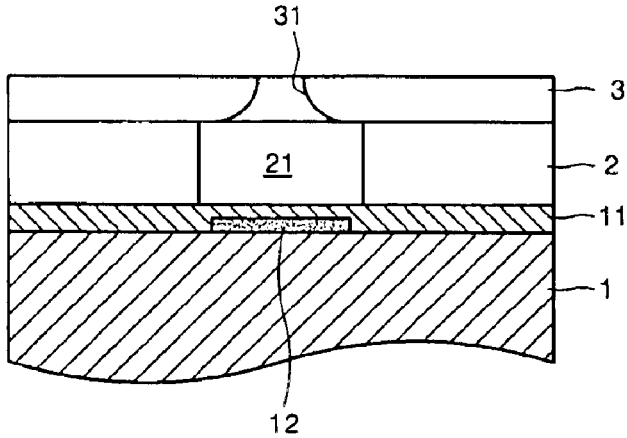
FIG. 2 (PRIOR ART)
FIG. 2 is a cross-sectional view of the conventional ink-jet printhead of FIG. 1.

Reference will now be made in detail to embodiments of the present invention, examples of which are illustrated in the accompanying drawings, wherein like reference numerals refer to the like elements throughout. The embodiments are described in order to explain the present invention by referring to the figures.

Figure 3:
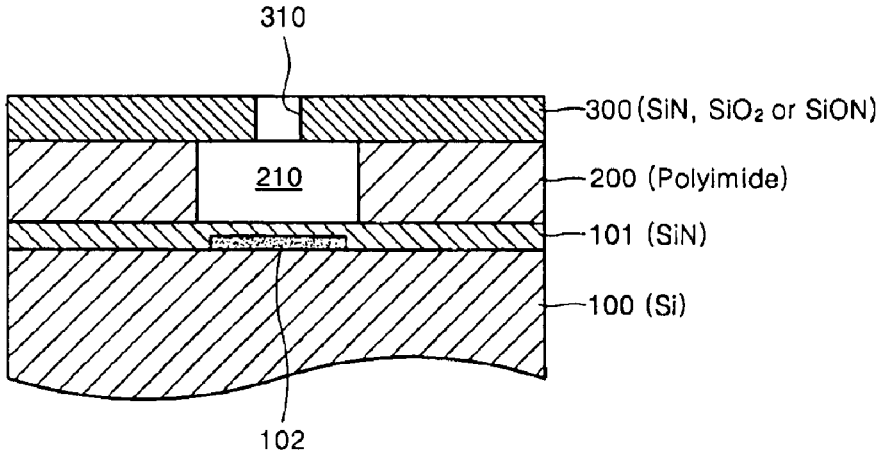
FIG. 3 is a cross-sectional view schematically illustrating an ink-jet printhead according to an embodiment of the present invention.

FIG. 3 is a cross-sectional view schematically illustrating an ink-jet printhead according to an embodiment of the present invention. A heater 102 is formed on a surface of a silicon (Si) substrate 100, and a passivation layer 101 is formed on the substrate 100. The heater 102 is an electric heating apparatus and is connected to a conductor and pads provided on the substrate 100. In FIG. 3, the conductor and pads have not been shown. A passage plate 200 formed of a photoresist, such as polyimide, is placed on the passivation layer 101. The passage plate 200 provides an ink chamber 210 placed above the heater 102 and an ink supply passage (not shown) supplying ink to the ink chamber 210. A nozzle plate 300 formed of a material different from the passage plate 200 is placed on the passage plate 200. The nozzle plate 300 is formed of a silicon-family material, for example, $SiO_2$, SiN, SiON, or the like, having a high adhering property to the photoresist, such as the polyimide. An orifice 310, which corresponds to the ink chamber 210 and through which ink droplets are ejected, is formed in the nozzle plate 300.

In the above structure, the passage plate 200 is formed of the photoresist, e.g., the polyimide. It is known that the polyimide does not have a good hydrophobic property nor a good adhering property. However, the passivation layer 101 on the substrate 100 and the nozzle plate 300 on the passage plate 200 are formed of a material selected from the silicon-family material, such as $SiO_2$, SiN, SiON, or the like, having a low deposition temperature and good adhering properties to firmly attach the passage plate 200 and the nozzle plate 300 to the substrate 100. The material for the nozzle plate 300 can be deposited on the passage plate 300 at a temperature limited by characteristics of the passage plate 200. For example, the polyimide can be deposited at a temperature lower than 350° C. Thus, the nozzle plate 300 can be formed directly over a polyimide layer, and the passage plate 200 and the nozzle plate 300 can be formed on the substrate 100 at a wafer level, that is, a plurality of printheads are formed on a wafer by forming a plurality of passage plates 200 and nozzle plates 300 on the wafer.

Figure 4:
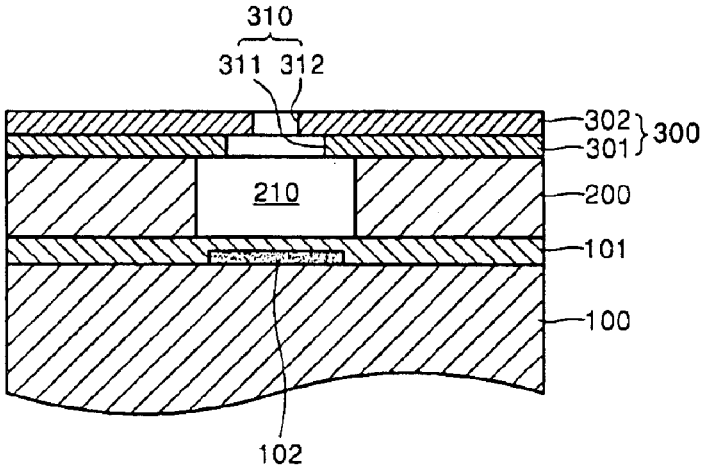
FIG. 4 is a cross-sectional view schematically illustrating another ink-jet printhead according to another embodiment of the present invention.

FIG. 4 is a cross-sectional view schematically illustrating another ink-jet printhead according to another embodiment of the present invention.

Referring to FIG. 4, the nozzle plate 300 includes first and second nozzle plates 301 and 302 in which first and second orifices 311 and 312 having different diameters are formed. It is possible that the first and second nozzle plates 302 are formed of the same material, in particular, the silicon-family material as described above. Due to the first and second orifices 311 and 312 formed in the first and second nozzle plates 301 and 302 respectively, a diameter of an orifice 310 of the nozzle plate 300 having the first and second nozzle plates 301 and 302 becomes narrower in a direction in which droplets fall or are ejected, to increase a directional accuracy of the droplets.

Hereinafter, a method of manufacturing the ink-jet printhead shown in FIG. 3 will be described.

In the following descriptions of the method of manufacturing the ink-jet printhead shown in FIG. 3, well-known techniques, in particular, techniques used to manufacture a conventional ink-jet printhead, will not be described in detail.

FIGS. 5A through 5F illustrate the method of manufacturing the ink-jet printhead shown in FIG. 3.

Figure 5A:
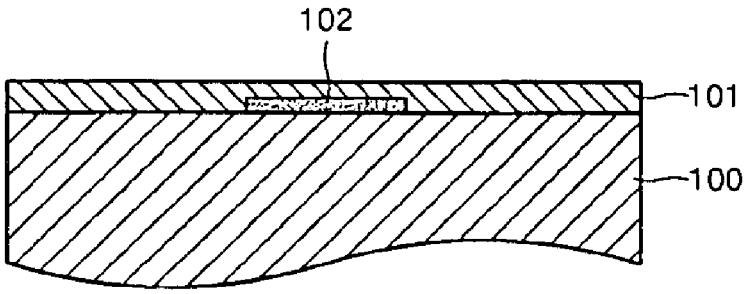
FIGS. 5A through 5F illustrate a method of manufacturing the ink-jet printhead shown in FIG. 3.

The substrate 100 in a silicon wafer state on which the heater 102 and lower layers including an SiN passivation layer 101 protecting the heater 102 are formed, is prepared as shown in FIG. 5A. The above operation is performed at the wafer level and is accompanied by an operation of forming a material for the heater 102, a patterning operation, and another operation of depositing the passivation layer 101 on the substrate 100.

Figure 5B:
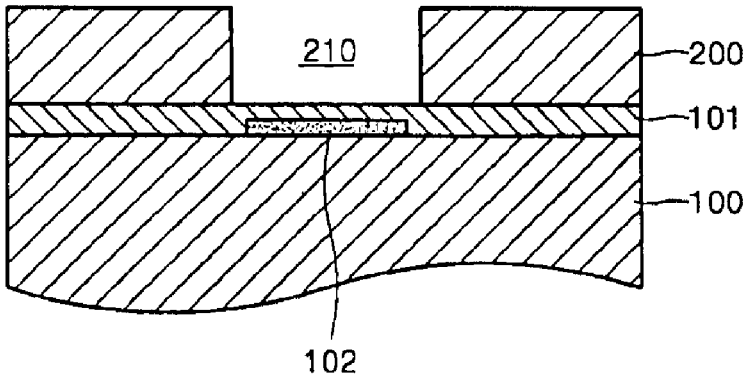

The photoresist, for example, the polyimide, is coated on an entire surface of the substrate 100 to a thickness of several tens of microns, for example, 30 microns, and is then patterned using photolithography, thereby forming an ink chamber 210 and an ink passage (not shown) connected to the ink chamber 210 as shown in FIG. 5B. After the above patterning operation is performed, an operation of forming the passage plate 200 is completed using the polyimide in a hard baking process.

Figure 5C:
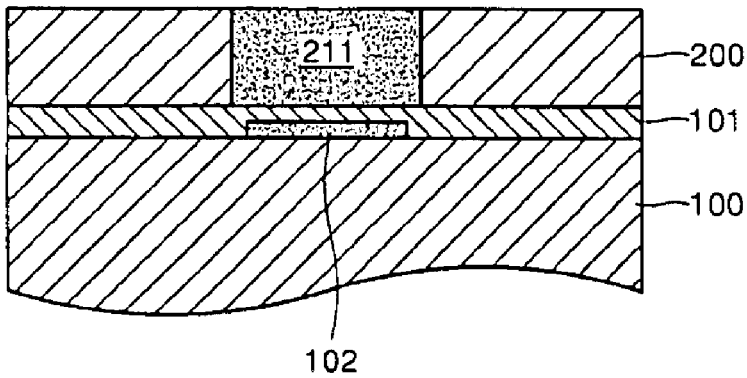

A mold layer 211 is formed of the photoresist in the ink chamber 210 as a sacrifice layer, as shown in FIG. 5C. Here, after the photoresist is coated on an entire surface of the passage plate 200 and a portion of the substrate 100, a photolithography process of performing an etch-back process in which the photoresist corresponding to only the ink chamber 210 remains may be applied to the photoresist formed on the passage plate 200 by using either an entire surface-etch process or a partial-exposure and etch process.

Figure 5D:
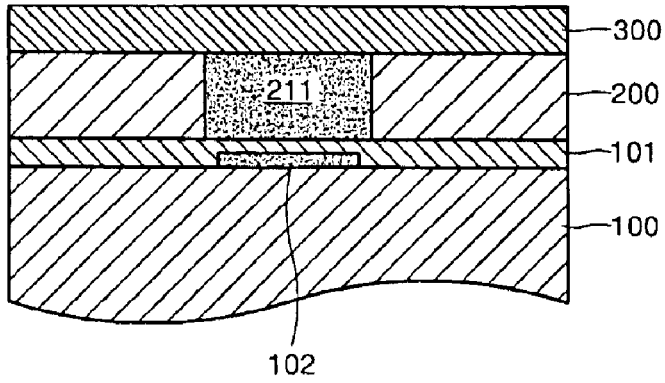

The nozzle plate 300 is formed on the passage plate 200 and the mold layer 211 by depositing an $SiO_2$, SiN, or SiON layer using a low temperature deposition method at a temperature under 400° C., for example, using plasma enhanced chemical vapor deposition (PECVD) as shown in FIG. 5D.

Figure 5E:
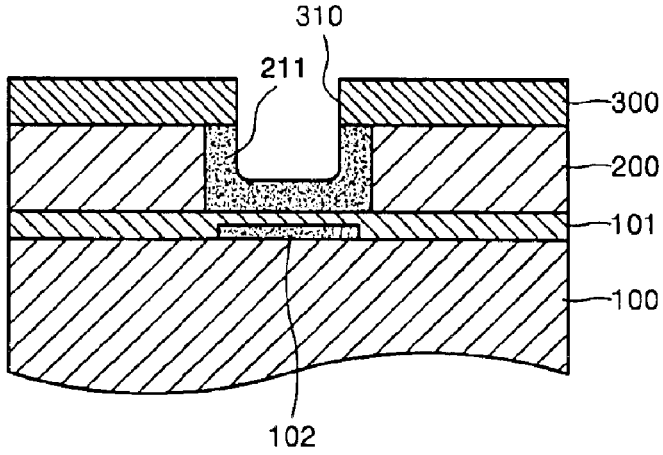

The orifice 310 corresponding to the ink chamber 210 is formed in the nozzle plate 300 as shown in FIG. 5E. The orifice 310 is formed when an operation of forming a mask using the photoresist and the patterning operation are performed through wet and dry etching.

Figure 5F:
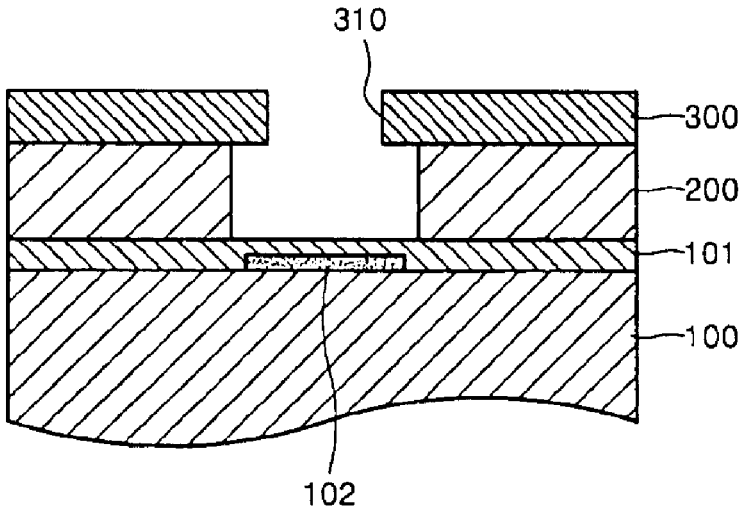

The mold layer 211 is removed from the ink chamber 210 as shown in FIG. 5F. Using ashing and striping processes performed during a process of removing the mask used for forming the orifice 310 after formation of the orifice 310, the mold layer 211 can also be removed from the ink chamber 210. A residue in the mold layer 211 and the photoresist remaining on another passage can be removed using a wet etchant after an operation of forming an ink feed hole on a rear surface of the substrate 100.

FIGS. 6A through 6H illustrate another method of manufacturing the ink-jet printhead shown in FIG. 4. The identical operations of the method shown in FIGS. 5A through 5F may be used in the method of FIGS. 6A through 6H.

Figure 6A:
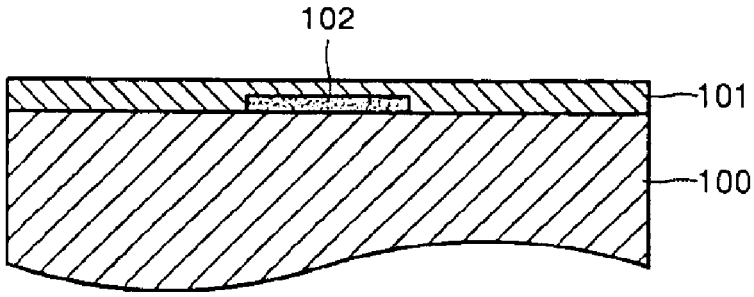
FIGS. 6A through 6H illustrate a method of manufacturing the ink-jet printhead shown in FIG. 4.

The substrate 100 in the silicon wafer state, on which the heater 102 and the lower layers including the SiN passivation layer 101 protecting the heater 102 are formed, is prepared as shown in FIG. 6A. The above operation is performed at the wafer level and is accompanied by an operation of forming the material for the heater 102, the patterning operation, and another operation of depositing the passivation layer 101 on the substrate 100.

Figure 6B:
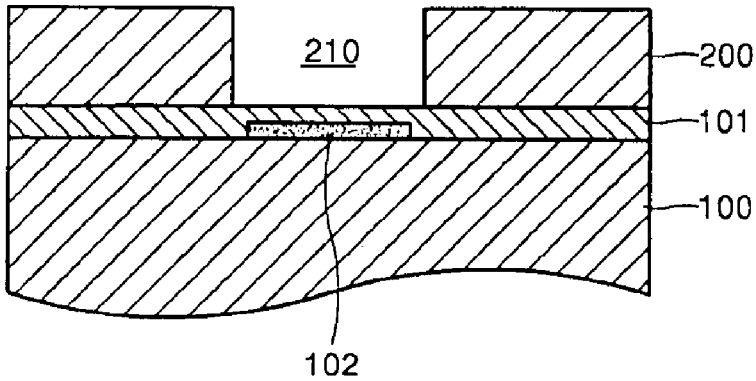

The photoresist, for example, the polyimide, is coated on the entire surface of the substrate 100 to a thickness of several tens of microns, for example, 30 microns, and is then patterned using the photolithography, thereby forming the ink chamber 210 and the ink passage (not shown) connected to the ink chamber 210 as shown in FIG. 6B. After the above patterning operation, the passage plate 200 is completed using the polyimide in the hard baking process.

Figure 6C:
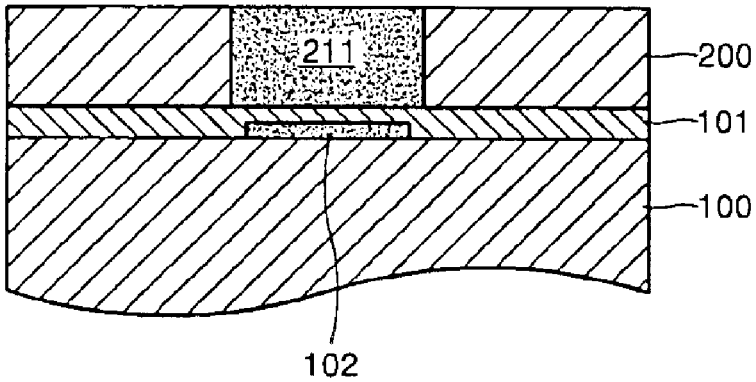

The mold layer 211 is formed of the photoresist in the ink chamber 210 as the sacrifice layer, as shown in FIG. 6C. Here, after the photoresist is coated on the entire surface of the passage plate 200 and a portion of the substrate 100, the photolithography process of performing the etch-back process in which the photoresist corresponding to only the ink chamber 210 remains may be applied to the photoresist formed on the passage plate 200 by using either the entire surface-etch process or a partial-exposure process and an etch process.

Figure 6D:
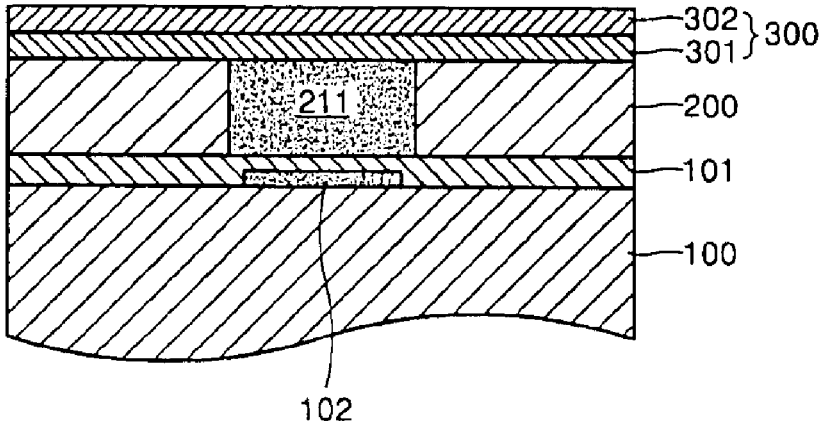

The nozzle plate 300 is formed on the passage plate 200 and the mold layer 211 by sequentially depositing an $SiO_2$, SiN, or SiON layer, that is, two layers 301 and 302, using a low temperature deposition method at a temperature under 400° C., for example, using the plasma enhanced chemical vapor deposition (PECVD) as shown in FIG. 6D. Here, a lower first nozzle plate 301 is formed of $SiO_2$, and an upper second nozzle plate 302 is formed of SiN having a wet etch rate higher than $SiO_2$.

Figure 6E:
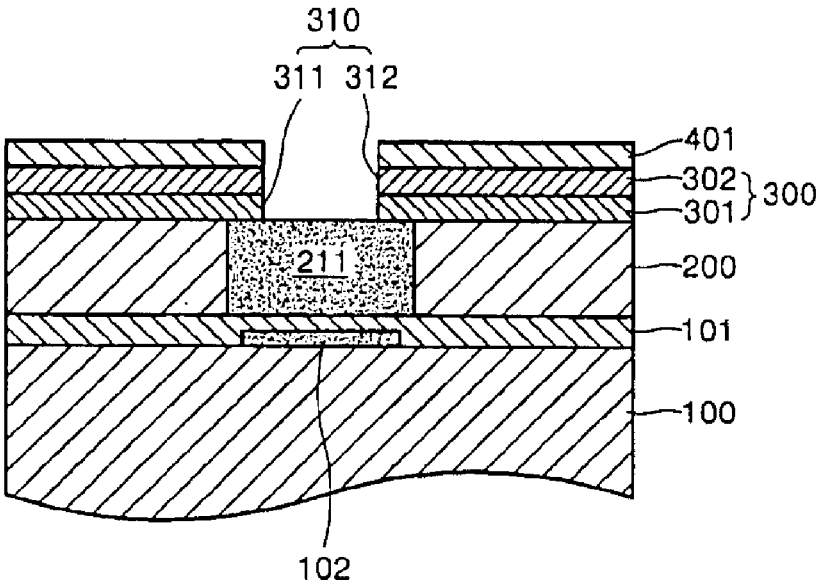

A photoresist mask 401 is formed on the nozzle plate 300 including the first nozzle plate 301 and the second nozzle plate 302, and the orifice 310 corresponding to the ink chamber 210 is then formed in the nozzle plate 300 using the photoresist mask 401 as shown in FIG. 6E. The orifice 310 includes the first orifice 311 formed in the first nozzle plate 301 and the second orifice 302 formed in the second nozzle plate 312. The first and second orifices 311 and 312 of the orifice 310 have the same diameters by etching using dry etching.

Figure 6F:
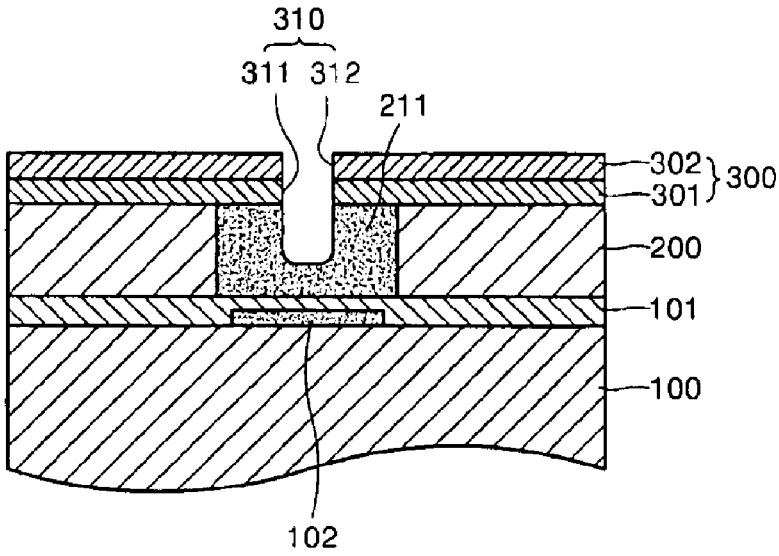

The mask 401 is removed using the ashing and stripping processes as shown in FIG. 6F. In this case, the mold layer 211 is removed together with the mask 401 from the ink chamber 210, and only a partial residual remains in the mold layer 211.

Figure 6G:
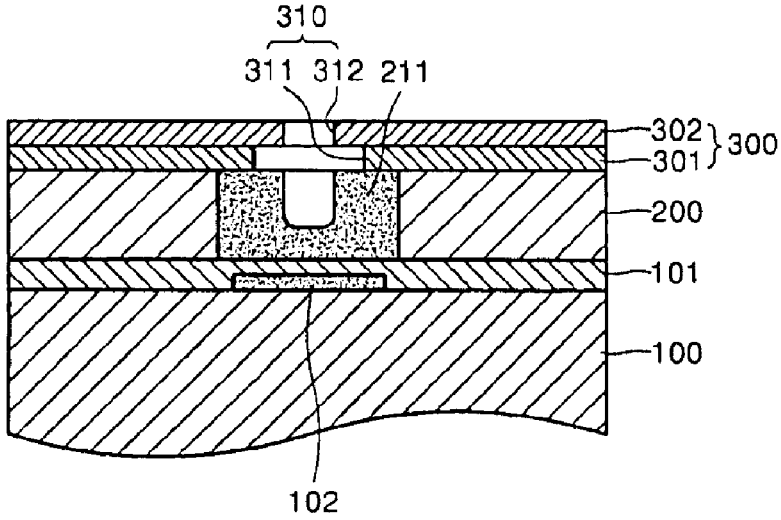
Figure 6H:
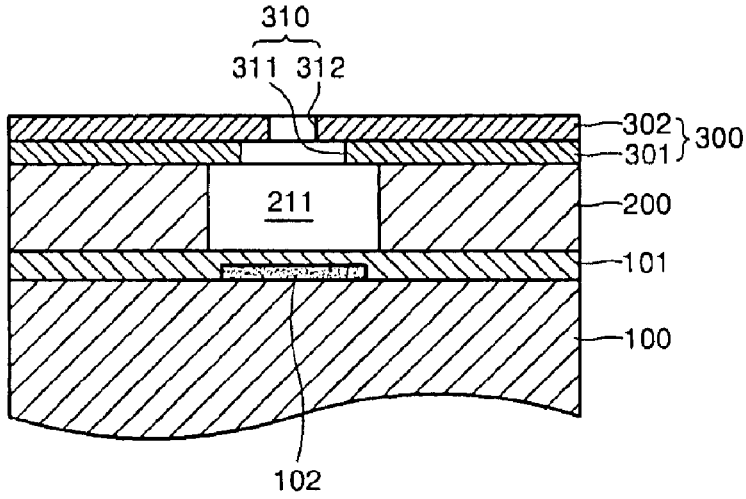

The first orifice 311 in the first nozzle plate 301 is etched by supplying HF, BOE, and LAL to the orifice 310, thereby increasing the diameter of the first orifice 311 as shown in FIG. 6G. The residual in the mold layer 211 and the photoresist existing on another passage can be removed using the wet etchant after an operation of forming an ink feed hole on the rear surface of the substrate 100, thereby completing a desired ink-jet printhead as shown in FIG. 4.

As described above, in the ink-jet printhead and the method of manufacturing the ink-jet printhead according to the present invention, even though a passage plate and a nozzle plate are separately formed, the passage plate and the nozzle plate can be well attached to a substrate such that the passage plate and the nozzle plate are continuously formed at a wafer level. Since it is possible that the passage plate and the nozzle plate are continuously formed on a wafer at the wafer level, yield of the ink-jet printhead is improved, and manufacturing costs are reduced. In addition, the nozzle plate is formed of a silicon-family material, such that the nozzle plate has a hydrophobic property. Thus, the nozzle plate is prevented from becoming soaked with the ink. In other words, the nozzle plate is prevented from being contaminated by the ink. Further, since the nozzle plate itself has the hydrophobic property, an additional coating layer is not needed.

While this invention has been particularly shown and described with reference to preferred embodiments thereof, it will be understood by those skilled in the art that various changes in form and details may be made therein without departing from the spirit and scope of the invention as defined by the appended claims and their equivalents.

What is claimed is:

1. An ink-jet printhead comprising:

a substrate on which at least one heater and a passivation layer protecting the at least one heater are formed;

a passage plate formed on the substrate to provide a chamber corresponding to the at least one heater; and a nozzle plate in which an orifice corresponding to the chamber is formed, wherein the passage plate is formed of photoresist, and the nozzle plate is formed entirely of a silicon-family material.

2. The printhead of claim 1, wherein the passage plate is formed of polyimide.

3. The printhead of claim 2, wherein the nozzle plate is formed of one of SiN, $SiO_2$, and SiON.

4. The printhead of claim 3, wherein the nozzle plate is formed through plasma enhanced chemical vapor deposition (PECVD).

5. The printhead of claim 1, wherein the nozzle plate comprises:

a first nozzle plate formed on the passage plate;

a second nozzle plate formed on the first nozzle plate;

a first orifice formed in the first nozzle plate; and a second orifice formed in the second nozzle plate.

6. The printhead of claim 5, wherein the first orifice has a diameter greater than that of the second orifice.

7. An ink-jet printhead comprising:

a substrate being in a form of a wafer on which at least one heater and a passivation layer protecting the at least one heater are formed;

a passage plate formed on the passivation layer of the substrate to provide a chamber corresponding to the at least one heater, and formed of a first material; and a nozzle plate in which an orifice corresponding to the chamber is formed, and formed on the passage plate using a second material different from the first material, wherein the nozzle plate is formed entirely of a silicon-family material.

8. The printhead of claim 7, wherein the pasivation layer is deposited on the substrate to surround the heater and formed of the second material.

9. The printhead of claim 7, wherein the passivation layer is disposed between the substrate and the passage plate and formed of a material having a low deposition temperature less than 350° C. to have a characteristic attaching the passage material to the substrate at the low deposition temperature.

10. The printhead of claim 7, wherein the first material is a non-silicon-family material, and the second material is a silicon-family material.

11. The printhead of claim 7, wherein the second material comprises:

one of $SiO_2$, SiN, and SiON.

12. The printhead of claim 7, wherein the first material is photoresist.

13. The printhead of claim 7, wherein the first material is polyimide.

14. The printhead of claim 7, wherein the first material has a characteristic of a low deposition temperature lower than 350° C. to be deposited on the passivation layer of the substrate at the low deposition temperature.

15. The printhead of claim 7, wherein the second material has a characteristic of a low deposition temperature lower than 400° C. to be deposited on the first material at the low deposition temperature.

16. The printhead of claim 7, wherein the nozzle plate is directly formed on the passage plate which is directly formed on the wafer of the substrate.

17. The printhead of claim 7, wherein the heater, the chamber of the passage plate, and the orifice of the nozzle plate have a common center axis.

18. The printhead of claim 7, wherein the substrate comprises another heater and another passivation layer formed adjacent to the another passivation layer and on the same wafer, and the printhead further comprises:

another passage plate formed on the another passivation layer to form another chamber; and another nozzle plate formed on the another passage plate to form another orifice.

19. The printhead of claim 18, wherein the passivation layer and the another passivation layer are formed in a single monolithic body formed on the wafer of the substrate.

20. The printhead of claim 18, wherein the passage plate and the another passage plate are formed in a single monolithic body formed on the passivation layer and the another passivation layer, and the nozzle plate and the another nozzle plate are formed in another single monolithic body formed on the passage plate and the another passage plate.

21. The printhead of claim 7, wherein the nozzle plate comprises:

a first nozzle plate formed on the passage plate, formed of the second material, and having a first orifice having a first area smaller that that of the chamber; and a second nozzle plate formed on the first nozzle plate, formed of the second material, and having a second orifice having a second area smaller than that of the first orifice.

* * * * *

UNITED STATES PATENT AND TRADEMARK OFFICE

CERTIFICATE OF CORRECTION

PATENT NO. : 6,880,916 B2
DATED : April 19, 2005
INVENTOR(S) : Yun-gi Kim

It is certified that error appears in the above-identified patent and that said Letters Patent is hereby corrected as shown below:

Title page,
Item [56], References Cited, U.S. PATENT DOCUMENTS, change "Schantz et al." to -- Schantzet et al. --.
FOREIGN PATENT DOCUMENTS, insert
-- JP 7266553 10/17/95 Abstract --.

Column 7,
Line 32, delete "." after "C".

Column 8,
Lines 5 and 9, delete "." after "C".
Line 38, change "that" to -- than --.

Signed and Sealed this

Third Day of January, 2006

JON W. DUDAS
*Director of the United States Patent and Trademark Office*